US008020792B2

(12) United States Patent
Theberge et al.

(10) Patent No.: US 8,020,792 B2
(45) Date of Patent: Sep. 20, 2011

(54) LOCKED CHARGE DETECTOR

(75) Inventors: Yvon Theberge, Aylmer (CA); Edward M. Stopper, Etters, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 1449 days.

(21) Appl. No.: 11/318,890

(22) Filed: Dec. 27, 2005

(65) Prior Publication Data

US 2007/0145168 A1 Jun. 28, 2007

(51) Int. Cl.
*B02C 25/00* (2006.01)

(52) U.S. Cl. ..... 241/30; 241/36

(58) Field of Classification Search ..... 241/30, 241/36

See application file for complete search history.

(56) References Cited

U.S. PATENT DOCUMENTS

| | | | | |
|---|---|---|---|---|
| 2,697,556 | A | 12/1954 | Turner | |
| 2,952,414 | A * | 9/1960 | Williamson | 241/30 |
| 3,904,857 | A | 9/1975 | Sandblom | |
| 4,174,072 | A | 11/1979 | Kline | |
| 4,491,767 | A * | 1/1985 | Eastcott et al. | 318/85 |
| 4,520,297 | A | 5/1985 | League, IV | |
| 4,609,155 | A | 9/1986 | Garnier | |
| 4,635,858 | A | 1/1987 | Welch et al. | |
| 5,330,109 | A | 7/1994 | Walter | |
| 5,390,866 | A * | 2/1995 | Kochnev et al. | 241/181 |
| 6,719,227 | B2 | 4/2004 | Scuccato | |
| 7,222,805 | B1 * | 5/2007 | Williams, Jr. | 241/89.1 |
| 2002/0175232 | A1 | 11/2002 | Scuccato et al. | |
| 2003/0057305 | A1 | 3/2003 | Watano et al. | |

OTHER PUBLICATIONS

Description Gearless Drive, Feb. 2001, 3 pages, I&S MP2, Siemens.
System Specification, SAG Mill Control, Jan. 10, 2001, 1 page, GE Industrial Systems.

* cited by examiner

*Primary Examiner* — Jimmy T Nguyen
(74) *Attorney, Agent, or Firm* — Rathe Patent & IP Law

(57) ABSTRACT

An apparatus includes a mill, a rotary actuator configured to apply torque to the mill, a sensor configured to sense a parameter corresponding to rotation of the mill and a controller configured to generate control signals based upon acceleration of the mill. Rotation of the mill is modified as a result of the control signals.

34 Claims, 3 Drawing Sheets

LOCKED CHARGE DETECTOR

BACKGROUND

Mills, such as grinding mills, typically include a drum which is loaded with a charge (ores, industrial minerals, rocks, steel grinding media, water, etc.) and is rotated. At start-up, the charge sometimes becomes solidified or locked. Continued rotation of the drum past a certain point may cause the locked charge to drop as a large mass instead of tumbling normally at a lower angle of mill rotation, potentially resulting in severe mechanical damage to the mill.

Some existing grinding mill manufacturers have attempted to address the problems created by locked charge. In one known system, an encoder is attached to a pinion to determine an angular position of the drum. The system systematically aborts a first mill start at a determined angle of rotation. From the mill position after roll back, the system determines whether the charge was locked. In particular, a mill with a locked charge will come back to its original position. Although effective, this grinding mill system requires an aborted start even if the charge is not locked.

Other known grinding mill systems attempt to identify the existence of a locked charge within the drum by either sensing motor torque, by sensing motor current or by sensing noise and vibration produced by a charge cascade. Such grinding mill systems require the use of specific motors or are specific to the characteristics of each mill and the amount and type of charge in the mill.

DETAILED DESCRIPTION OF EXAMPLE EMBODIMENTS

Figure 1A:
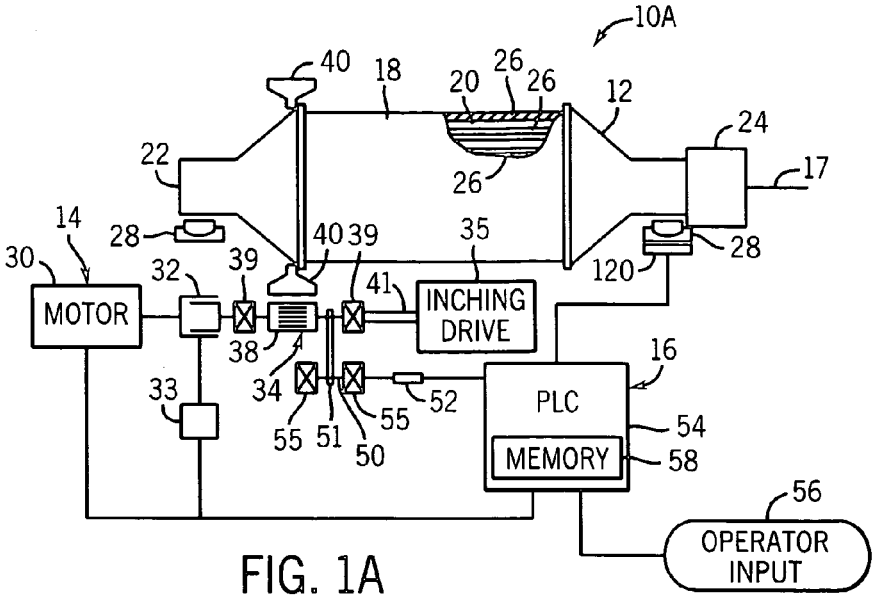
FIG. 1A is schematic illustration of a grinding mill system according to an example embodiment.

FIG. 1A is a schematic illustrations of one embodiment of a grinding mill system 10A configured to grind or otherwise treat a charge. In the particular example shown, grinding mill system 10A is specifically configured to grind a charge. Grinding mill system 10A generally includes mill 12, rotary actuator 14, and controller system 16. Mill 12, also known as a drum, comprises a container or receptacle configured to receive a charge of material to be ground or otherwise treated. Although mill 12 is illustrated as having a generally cylindrical shape with opposite frustral-conical ends, mill 12 may alternatively have a variety of other shapes and configurations. In the particular embodiment shown, mill 12 is configured to be rotated about axis 17 on bearings 28 so as to mix and move the material charge contained within interior 20. In the particular example shown, axis 17 is substantially horizontal so as to uniformly contain the interior charge within mill 12. In other embodiments, mill 12 may be rotated and supported for rotation about an axis which was inclined. Mill 12 includes a wall 18, a portion of which is broken away to reveal an interior 20, inlet 22 and outlet 24.

Inlet 22 generally comprises an opening into interior 20 through which the charge of material is loaded into mill 12. Outlet 24 generally comprises an opening through which the ground or otherwise treated charge of material is discharged from mill 12. In the particular example shown, inlet 22 and outlet 24 extend at generally opposite ends of mill 12. In other embodiments, inlet 22 and outlet 24 may have other locations or may be provided by a single opening within mill 12.

In the particular example shown in which mill 12 is specifically configured for grinding a material charge, such as mineral aggregate, mill 12 additionally includes lifters 26. Lifters 26 comprise structures such as internal formations, veins, bars, projections and the like which project from wall 18 towards a center of mill 12. Lifters 26 engage and lift the material charge as mill 12 is rotated about axis 17 such that the material falls upon itself within interior 20. In one embodiment, lifters 26 comprise elongate bars which are mounted to wall 18 along interior 20 so as to at least partially line the interior 20 of mill 12. Additional intermediate liners may also be provided. In other embodiments, lifters 26 are integrally formed as part of a single unitary body with wall 18. In still other embodiments, lifters 26 may be omitted or may be replaced with other structures to that line wall 18 along interior 20.

Rotary actuator 14 generally comprises one or more structures or devices configured to rotatably drive mill 12 about axis 17. In the particular example shown, rotary actuator 14 includes motor 30, clutch 32, clutch control 33, drive line 34 and inching drive 35. Motor 30 comprises a device configured to generate rotational power, force or torque. In the particular example shown, motor 30 is configured to generate a torque having a fixed or constant speed. In the particular example shown, motor 30 comprises a low starting torque, synchronous fixed speed electrical motor. Because motor 30 comprises a synchronous electrical motor, motor 30 enables power factor correction which may reduce electrical waste and increase efficiency without the need for capacitors and the like. In the particular example shown, motor 30 comprises a low speed synchronous motor commercially available from General Electric located at Peterborough, Ontario, Canada. In other embodiments, motors 30 may comprise an alternative torque generating device such as other forms of electric motors, a hydraulic motor or a fuel powered engine or motor such as a combustion engine.

Clutch 32 and clutch control 33 comprises a device configured to selectively transmit torque generated by motor 30 to drive line 34. Clutch 32 is operably coupled between motor 30 and drive line 34 and is in communication with controller 33. Clutch control 33 comprises the currently developed or future developed controller operably coupled to clutch 32 and configured to actuate clutch 32 between different states in which different amounts of torque are transmitted to drive line 34. Clutch controller 33 serves as a manual interface to clutch 32. Clutch controller 33 is configured to enable manual intervention and control of clutch 32. As a result, clutch control 33 allows an operator to manually actuate clutch 32 between its engaged and disengaged states so as to manually continue or cessate the transmission of torque so as to stop or continue rotation of mill 12. Clutch control 33 allows manual control of the rotation of mill 12, bypassing control from control system 16.

In the particular example shown, clutch 32 is configured to selectively transmit varying amounts of positive torque to drive line 34. In one embodiment, clutch 32 is configured to transmit a linearly increasing amount of torque to drive line 34. According to one exemplary embodiment, clutch 32 comprises an air or pneumatic clutch, wherein air or gas is utilized to actuate the clutch between various torque transmitting states. In one embodiment, clutch 32 comprises an Eaton, Airflex or Wichita pneumatic clutch sold by Eaton Airflex Division, located at Cleveland, Ohio; Wichita Falls, Tex. In other embodiments, other pneumatic clutches, hydraulic clutches, mechanical clutches or other devices and their associated controllers configured to selectively transmit torque may alternatively be employed.

Drive line 34 comprises one or more structures configured to transmit and deliver torque to mill 12 so as to rotate mill 12 about axis 17. Drive line 34 is operably coupled between clutch 32 and mill 12. In the particular example shown, drive line 34 comprises a series of gears including pinion gear 38 supported by bearings 39 and annular gear 40. Annular gear 40 is fixed to mill 12. Although drive line 34 is illustrated as including pinion gear 38 and annular gear 40, drive line 34 may alternatively include alternative gears as well as a greater or fewer number of such gears for transmitting torque so as to rotate mill 12. In still other embodiments, drive line 34 may include other mechanisms for transmitting torque such as chain and sprocket arrangements, belt and pulley arrangements or combinations thereof.

Inching drive 35 comprises a low speed hydraulic or mechanical drive operably coupled to drive line 34 by a shiftable coupling 42. Inching drive 35 is configured to rotatably drive mill 12 at a relatively low speed to facilitate repair and maintenance of mill 12. In other embodiments, inching drive 35 and shiftable coupling 42 may be omitted.

Control system 16 generally comprises an arrangement of components configured to sense at least one parameter corresponding to the rotation of mill 12 about axis 17, to determine acceleration of the rotation of mill 12 about axis 17 and to control and adjust the rotation of mill 12 about axis 17 based upon a determined acceleration. In one embodiment, control system 16 is specifically configured to control the transmission of or cessate the transmission of torque delivered to mill 12 to rotate mill 12 based upon a determined rate of acceleration of mill 12 about axis 17. Control system 16 uses the detected or determined acceleration of mill 12 about axis 17 as a fundamental indication of what is happening to the charge of material within interior 20 of mill 12. In the particular example shown in FIG. 1A, control system 16 uses the detected or determined acceleration of mill 12 to specifically identify if and when the charge of material within interior 20 of mill 12 has cascaded or if the charge has remained in a solidified or locked state. By determining whether the charge of material within interior 20 of mill 12 has cascaded or remains in a solid or solidified or locked state based upon the determined acceleration of mill 12 about axis 17, control system 16 may automatically abort a start-up of the rotation of mill 12 when the charge is locked and may allow start-up of the rotation of mill 12 to continue when the charge has cascaded.

In the particular example shown in FIG. 1A, control system 16 generally includes auxiliary drive shaft 50, coupler 51, sensor 52, controller 54 and operator input 56. Auxiliary drive shaft 50 comprises a member operably coupled to annular gear 38 and configured to rotate in response to rotation of gear 40 and mill 12. In the particular example shown, auxiliary drive shaft 50 is rotatably supported by bearings 55 and is operably coupled to pinion gear 38 of drive line 34 by coupler 51 which constitutes a drive mechanism such as a belt, chain, gear train or the like transmitting torque from drive line 34 to drive shaft 50.

Sensor 52 generally comprises one or more components configured to specifically sense at least one parameter corresponding to the rotation of mill 12 about axis 17. In the particular example shown, sensor 52 directly senses rotation of auxiliary drive shaft 50 which corresponds to the rotation of mill 12. In other embodiments, sensor 52 may sense other parameters or structures which rotate in correspondence to or in proportion with the rotation of mill 12. For example, in other embodiments, sensor 52 may be configured to directly sense the rotation of mill 12 as it rotates about axis 17. In still other embodiments, auxiliary drive shaft 50 may be omitted and sensor 52 may be configured to sense the rotation of other components such as pinion gear 38, annular gear 40 or other components of drive line 34.

In the particular example shown, sensor 52 is an encoder. In one particular embodiment, sensor 52 constitutes an AB845HSJDZ24CMY16 encoder commercially available from Allen-Bradley. In other embodiments, other encoders may be utilized. In other embodiments, sensor 52 may have other configurations or may be mouthed to other rotating structures of system 10A which rotate in proportion to the rotation of mill 12.

In still another embodiment, sensor 52 may comprise an optical sensor having a light emitter and a light detector, wherein emitted light received by the light detector varies based upon the rotation of mill 12 or another member that rotates in proportion with or correspondence to the rotation of mill 12. In still other embodiments, various other currently developed or future developed sensing arrangements may be utilized. Such sensors may be configured to sense rotation of mill 12 which may include the acceleration of mill 12 and the rate of acceleration of mill 12.

Controller 54 generally comprises one or more processing units in communication with sensor 52, motor 30 and clutch 32. For purposes of this disclosure, the term "processing unit" shall include a currently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 54 is not limited to any specific combination of hardware circuitry and software, nor to any particular source for the instructions executed by the processing unit.

In the particular example shown, controller 54 comprises a programmed logic controller (PLC) operating according to instructions contained in a computer readable medium or memory 58. Memory 58 includes instructions directing controller 54 to receive signals from sensor 52 representing rotation of mill 12 and to generate and transmit control signals which cause the rotation of mill 12 to be modified based upon the determined acceleration. In the particular example illustrated, controller 54 additionally includes a high speed module configured to interface with sensor 52, constituting an encoder, so as to determine acceleration and angle of the rotation of mill 12 based upon electrical pulses. In one embodiment, the high speed module incorporated as part of sensor 54 may constitute an NB 1756-HSC commercially available from Allen-Bradley. In the particular example shown, controller 54 is configured to calculate a rate of acceleration of mill 12 about axis 17 and to generate control signals based upon this rate of acceleration. The control signals result in the torque that is transmitted to mill 12 to rotate mill 12 to be modified.

In the particular example shown, the control signals generated by controller 54 are transmitted to clutch controller 33, wherein clutch controller 33 modifies the amount of torque being transmitted to clutch 32 in response to the control signals. In the particular embodiment shown in which clutch 32 comprises a pneumatic clutch, control signals from controller 54 result in one or more valves being modified, such as with a solenoid, to adjust an amount of air pressure within the pneumatic clutch. According to one exemplary embodiment, if controller 54 determines that the charge within interior 20 of mill 12 has not cascaded but remains in a solidified or locked state at a certain degree of rotation of mill 12, controller 54 generates control signals which cause one or more valves to be opened so as to depressurize and disengage the pneumatic clutch 32. This results in no additional torque being transmitted to mill 12 and minimizes or prevents a solidified or locked charge from dropping and causing damage to mill 12.

According to one embodiment, controller 54 receives and analyzes signals from sensor 52 to determine the rate of acceleration of mill 12 for a predetermined degree of rotation of mill 12 from start-up. In one embodiment, controller 54 receives and analyzes signals from sensor 52 for an initial rotation of mill 12 by about 75 degrees about axis 17 from start-up. If controller 54 has not identified a cascading or tumbling of charge within mill 12 based upon or using the determined acceleration of mill 12 prior to rotation of mill 12 by 75 degrees from start-up, controller 54 generates control signals (or fails to generate control signals), causing transmission of torque from motor 30 by clutch 32 to mill 12 to stop or to be cessated.

Operator input 56 comprises a device configured to allow an operator to enter information, instructions or parameters for adjusting the operation of control system 16. For example, a particular ore or other material being processed within mill 12 may be known to cascade or tumble at an earlier time or degree of rotation of mill 12. Operator input 56 may be utilized by an operator to enter an alternative mill rotation abortion threshold in lieu of the aforementioned 75 degrees. In one embodiment, the threshold may be adjusted such that controller 54 generates or fails to generate control signals which result in the cessation of the transmission of torque from motor 30 to mill 12 by clutch 32 if the material within mill 12 has not cascaded or tumbled (as determined from the acceleration of mill 12 by controller 54) prior to rotation of mill 12 through 50 degrees to 65 degrees from initial start-up. In lieu of enabling an operator to enter or specify an alternative angular degree of rotation threshold value, operator input 56 may alternatively be configured to enable an operator to enter a name or one or more other characteristics of the particular material being processed within mill 12. In response to receiving such information through operator input 56, controller 54 may be configured to consult memory 58 to determine an appropriate mill operation abortion degree of rotation threshold value based upon the input characteristics of the material being processed. In one embodiment, processor 54 may consult a look-up table having degree of rotation threshold values that correspond to particular material types of material that may be processed within mill 12. Operator input 56 may comprise a keyboard, a push button, a microphone with voice recognition, a slide bar, a mouse, a touchpad or one of various other currently developed or future developed interface devices to allow an operator to enter instructions or information to controller 54.

Figure 1B:
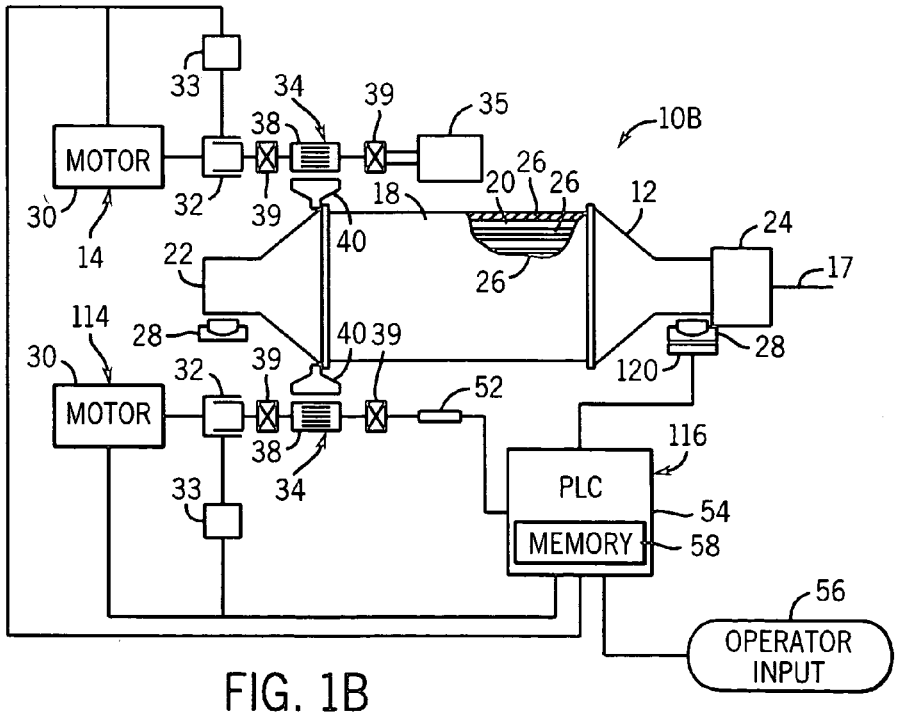
FIG. 1B is a schematic illustration of another embodiment of a grinding mill system according to an example embodiment.

FIG. 1B schematically illustrates grinding mill system 10B, another embodiment of grinding mill system 10A shown and described with respect to FIG. 1A. Grinding mill system 10B is similar to grinding mill system 10A except that grinding mill system 10B is a dual drive system rather than a single drive system. In particular, grinding mill system 10B additionally includes rotary actuator 114 and alternatively includes control system 116 in lieu of control system 16. Those remaining components of grinding mill system 10B which correspond to components of grinding mill system 10A are numbered similarly. Rotary actuator 114 is similar to rotary actuator 14 in that rotary actuator 114 includes motor 30, clutch 32, clutch control 33 and drive line 34, described above with respect to rotary actuator 14. Unlike rotary actuator 14, rotary actuator 114 omits inching drive 35. In other embodiments, rotary actuator 114 may alternatively include inching drive 35, whereas rotary actuator 14 omits inching drive 35. In some embodiments, inching drive 35 may be omitted. Rotary actuator 114 cooperates with rotary actuator 14 to supply torque so as to rotate mill 12 about axis 17.

Control system 116 of grinding mill system 10B is similar to control system 16 of grinding system 10A except that control system 116 omits drive shaft 50, coupler 51 and bearings 55. In contrast to control system 16, control system 116 has a sensor 52 directly or near directly operably coupled to pinion gear 38 of drive line 34. Because grinding mill system 10B includes two rotary actuators 14 and 114, inching drive 35 may be coupled to pinion gear 38 of one of rotary actuators 14, 114 while sensor 52 is operably coupled to the other of rotary actuators 14, 114. As a result, drive shaft 50, coupler 51 and bearings 55 may be omitted. In addition, generally less expensive lower starting torque providing motors 30 and other associated components may be employed in grinding mill system 10B for rotatably driving grinding mill 12.

Figure 2:
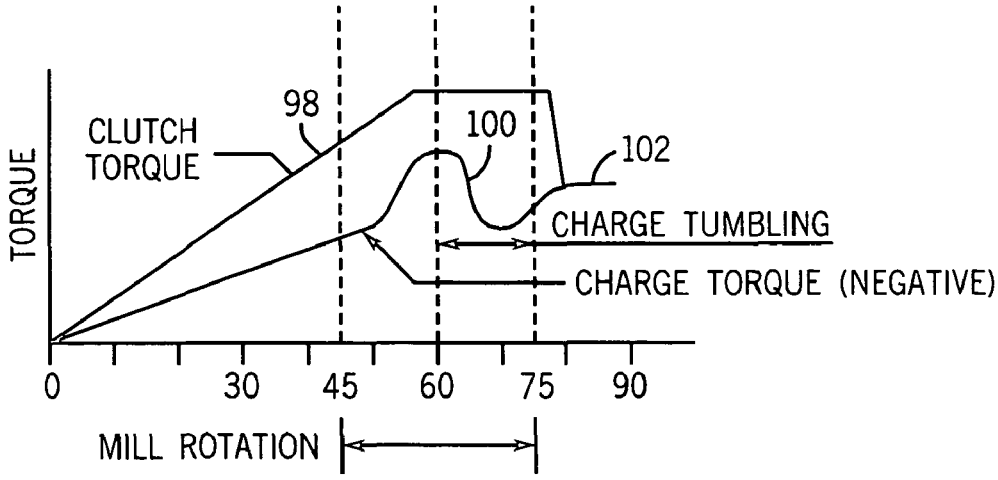
FIG. 2 is a graph illustrating clutch torque and charge torque as a function of mill rotation during a first example start-up scenario for the systems of FIGS. 1A and 1B.
Figure 3:
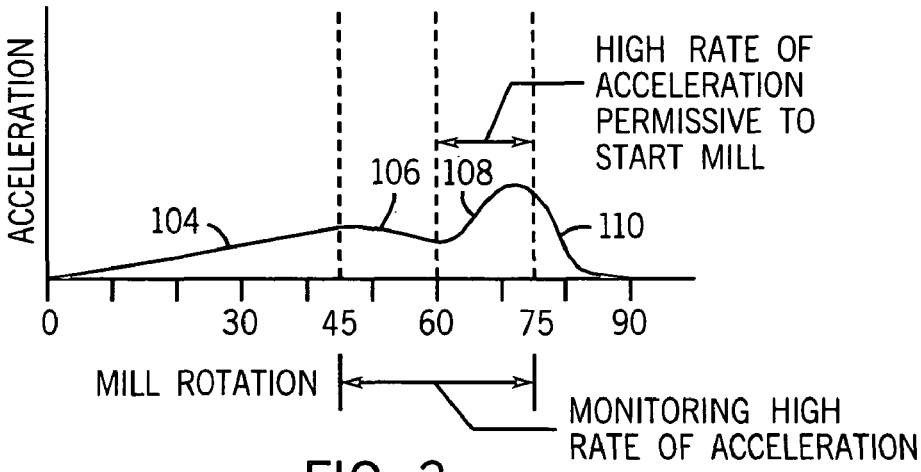
FIG. 3 is a graph illustrating acceleration of the mill of the systems of FIGS. 1A and 1B as a function of mill rotation during the first example start-up scenario.

FIGS. 2 and 3 illustrate one example of a start-up scenario for grinding mill systems 10A and 10B. FIG. 2 is a graph depicting torque being transmitted by clutch 32 to mill 12 provided by clutch sliding friction (also known as driving torque) and the torque exerted upon the mill by the charge and mill inertia (mill torque) contained within the drum wanting to return to dead bottom center under the force of gravity referred to as charge torque (also known as braking torque). FIG. 3 is a graph depicting acceleration of the drum as the drum begins to rotate following the initiation of a start-up. In general, the angular accelerating torque of mill 12 is the sum of the clutch torque and the negative mill torque (clutch torque minus mill torque). Prior to cascading of the charge within mill 12, the charge generally behaves like a solid.

In the particular examples shown in which clutch 32 is a pneumatic clutch, clutch torque is a function of air pressure in the clutch. As shown by FIG. 2, controller 54 (shown in FIG. 1) generates control signals which direct one or more air sources (i.e., compressors) and actuates one or more valves (via solenoids, etc.) to linearly increase the air pressure within clutch 32 until clutch 32 is completely filled with air. As indicated by line 98, as clutch 32 is filled with air, clutch torque also linearly increases with time until the clutch is completely filled with air to a pre-determined pressure, at which point, the clutch torque remains constant.

As further shown by FIG. 2, upon initiation of start-up (indicated at zero mill rotation), the charge torque is also at zero when the charge of material is at the dead bottom center. As the mill 12 begins to rotate, the charge torque generally increases with the sine of the angular rotation. As indicated by downward curve 100, the charge of material cascades or breaks off and tumbles, the charge torque rapidly decreases. As indicated by curve segment 102, after initial cascade, the charge torque is relatively constant and is a function of the final angle of repose of the charge of material in mill 12.

FIG. 3 illustrates the acceleration of mill 12 during start-up as determined by controller 54 based upon signals received from sensor 52. As indicated by segment 104, the acceleration of mill 12 slowly increases as the clutch torque (shown in FIG. 2) is linearly increased and while the charge torque is also slowly increasing (up to approximately 45 degrees of rotation of mill 12 in the example shown). As indicated by segment 106, following the slowly increasing acceleration of mill 12, the acceleration of mill 12 slowly decreases until the charge of material within mill 12 begins to cascade or tumble (in the example, the charge begins to cascade after mill 12 has rotated approximately 60 degrees). As indicated by segment 108, once the charge of material within mill 12 has begun to cascade, mill 12 experiences a high rate of acceleration due to the sudden reduction in the charge torque, combined with a reduction of the overall rotating inertia as the charge breaks off or away from the walls 18 of mill 12. Thereafter, as indicated by segment 110, the acceleration of mill 12 generally decreases to zero fairly rapidly.

In operation, sensor 52 senses and detects one or more parameters corresponding to the rotation of mill 12 and transmits representative signals to controller 54. Controller 54 calculates the acceleration and the rate of acceleration of mill 12 using such signals from sensor 52. In one embodiment, controller 54 compares sensed angular positions of mill 12 over predetermined time intervals to determine the rate of acceleration of mill 12. If controller 54 determines that the rate of acceleration of mill 12 exceeds a predetermined rate of acceleration for mill 12 prior to a predetermined degree of rotation, controller 54 allows the start-up of mill 12 to continue. In particular, controller 54 controls or directs clutch 32 so as to continue to transmit torque to drive line 38 and mill 12 so as to continue to rotate mill 12. Alternatively, if controller 54 does not detect a rate of acceleration of mill 12 during start-up that exceeds a predetermined rate prior to a predetermined degree of rotation, controller 54 generates control signals which cause rotary actuator 14 to cease the application of torque to mill 12. In the particular example illustrated, controller 54 generates control signals that direct clutch 32 to cease the transmission of torque to mill 12. In the particular example illustrated in which clutch 32 comprises a pneumatic clutch, controller 54 generates control signals causing a solenoid or other actuator to open one or more valves discharging air pressure within clutch 32 so as to completely disengage clutch 32.

In the particular start-up scenario shown in FIGS. 2 and 3, controller 54 monitors the acceleration of mill 12 only during a predetermined portion of the rotation of mill 12 during start-up. In the example shown, controller 54 monitors signals from sensor 52 beginning at 0 degrees rotation to approximately 75 degrees. In the exemplary start-up scenario shown in FIG. 3, mill 12 exhibits a high rate of acceleration prior to the rotation of mill 12 through 75 degrees. Because it has been discovered that the high rate of acceleration as detected by controller 54 corresponds to the cascading or tumbling of charge within mill 12, controller 54 generates control signals (or alternatively does not generate any control signals) that permit the continued transmission of torque by clutch 32 to mill 12 to continue rotatably driving mill 12 beyond 75 degrees.

Figure 4:
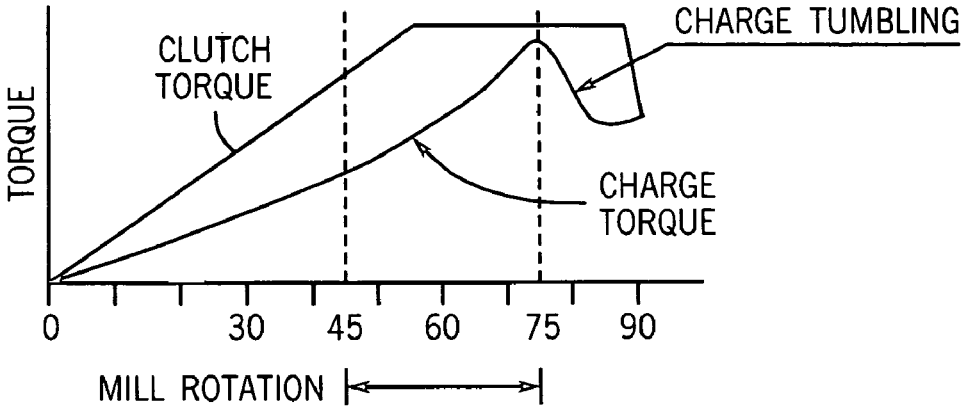
FIG. 4 is a graph illustrating clutch torque and charge torque as a function of mill rotation during a second example start-up scenario of the systems of FIGS. 1A and 1B.
Figure 5:
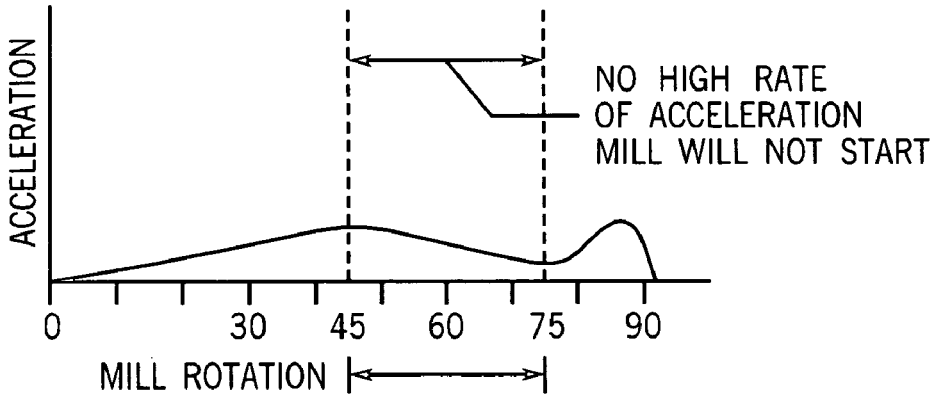
FIG. 5 is a graph illustrating an acceleration of the mills of the systems of FIGS. 1A and 1B as a function of mill rotation during the second example start-up scenario.

FIGS. 4 and 5 illustrate an alternative scenario for the start-up of mill 12. In particular, FIGS. 4 and 5 illustrate an example of where the charge of material within mill 12 does not cascade or tumble prior to a predetermined degree of rotation during start-up and remains solidified or locked. As shown by FIG. 4, as mill 12 begins to rotate, the charged torque generally increases with the sine of the angular rotation of mill 12. However, in contrast to the scenario illustrated in FIGS. 2 and 3, the charge of material within mill 12 does not cascade or tumble prior to mill 12 being rotated approximately 75 degrees. As shown by FIG. 5, the rate of acceleration of the rotation of mill 12 also does not rapidly increase until after mill 12 has rotated approximately 75 degrees. As a result, the solidified or locked charge of material within mill 12 is susceptible to dropping or falling, potentially causing damage to mill 12 and system 10.

In such a scenario, controller 54 (shown in FIG. 1) generates control signals (or alternatively does not generate control signals) causing the torque being transmitted to mill 12 to be ceased. In the particular embodiment shown, controller 54 generates control signals causing clutch 32 to be disengaged so as to cease the transmission of torque to mill 12. In the particular embodiment shown in which clutch 32 comprises a pneumatic clutch, controller 54 generates control signals which cause one or more actuators, such as solenoids to open one or more valves to rapidly decrease air pressure within clutch 32 and to disengage clutch 32.

Once again, in the particular example shown in FIGS. 4 and 5, controller 54 monitors signals from sensor 52 and calculates the acceleration or rate of acceleration of mill 12 until mill 12 is rotated approximately 75 degrees. Because controller 54 does not detect the high rate of acceleration of mill 12 prior to mill 12 rotating through approximately 75 degrees, the start-up of mill 12 is aborted.

In other embodiments, controller 54 may alternatively be configured to sense and/or calculate the acceleration or rate of acceleration of mill 12 for longer or shorter periods of time and may also be configured to abort a start-up of mill 12 based upon the acceleration of mill 12 failing to attain a threshold value prior to another point in time. Controller 54 may also be alternatively configured to cause the start-up to be aborted if the calculated acceleration or rate of acceleration has not exceeded a predetermined threshold prior to the mill being rotated greater than 75 degrees or less than 75 degrees from its at rest position.

Overall, systems 10A and 10B minimize or prevent damage to mill 12 or other components of systems 10A and 10B caused by the fall or drop of solidified or locked charges during start-up. At the same time, systems 10A and 10B detects the cascading or tumbling of a charge within mill 12 during start-up to allow the start-up to continue in such circumstances. Because systems 10A and 10B monitor mill acceleration as a fundamental indication of what is happening to the charge in mill 12, systems 10A and 10B require little modification, if any, to adapt to different mills, different liners, different mill sizes or different amounts of charge within the mill. Because systems 10A and 10B monitor mill acceleration as a fundamental indication of what is happening to the charge in mill 12, systems 10A and 10B may utilize a synchronous motor. As a result, systems 10A and 10B facilitate space savings, power factor correction and overall electrical power consumption efficiency. Because systems 10A and 10B may detect a locked charge with a reduced number of manual start-ups, wear of clutch 32 is reduced, prolonging the useful life of such systems.

FIGS. 1A and 1B illustrate but two examples. Although control systems 16 and 116 are illustrated as being utilized in conjunction with mill 12 and rotary actuators 14 and 114, control systems 16 and 116 may alternatively be utilized with alternative mills or drums and with alternative rotary actuators. Although control systems 16 and 116 and rotary actuators 14 and 114 are illustrated as being utilized in conjunction with a grinding mill 12, control systems 16 and 116 and rotary actuator 14 and 114 may alternatively be utilized with other mills, drums or containers wherein a charge of particulate or aggregate material is loaded into the mill, drum or container and is rotated during treatment or other modification of the charge of material.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus for detecting locked charge, comprising:

a mill; a rotary actuator configured to apply torque to the mill;

a sensor configured to sense a parameter corresponding to rotation of the mill; and a controller configured to generate control signals based upon an acceleration of the rotation of the mill during start-up, wherein the control signals cause rotation of the mill to be modified.

2. The apparatus of claim 1, wherein the rotary actuator is, at least in part, controlled by the control signals.

3. The apparatus of claim 1, wherein the controller is configured to calculate a rate of acceleration of the mill and wherein the control signals are generated based upon the rate of acceleration.

4. The apparatus of claim 1, wherein the rotary actuator includes a fixed speed motor.

5. The apparatus of claim 4, wherein the motor is a synchronous motor.

6. The apparatus of claim 1, wherein the rotary actuator includes: a driver; and a clutch operably coupled between the driver and the mill.

7. The apparatus of claim 4 including a clutch operably coupled between the motor and the mill.

8. The apparatus of claim 7, wherein the clutch is an air clutch.

9. The apparatus of claim 1, wherein the mill includes circumferentially spaced lifters along an inner surface of the mill.

10. The apparatus of claim 1, wherein the mill is configured to receive, grind and discharge material.

11. The apparatus of claim 1, wherein a mill is configured to rotate about a substantially horizontal axis.

12. The apparatus of claim 1, wherein the controller is configured to automatically generate control signals in response to a detected rate of acceleration of the mill during start-up failing to exceed a predetermined rate, wherein the rotary actuator ceases application of torque to the mill in response to the control signals.

13. The apparatus of claim 12, wherein the controller is configured to only transmit the control signals during a predetermined extent of rotation of the mill during start-up.

14. The apparatus of claim 13, wherein the predetermined extent of rotation of the mill is approximately 75 degrees.

15. The apparatus of claim 12, wherein the controller is configured such that the generation of the control signals only occurs prior to the mill being rotated to a substantially constant speed.

16. The apparatus of claim 1 further comprising an operator input configured to facilitate operator input of a degree of rotation threshold value up to which the mill may rotate prior to cascading of material in the mill before the controller generates control signals causing rotation of the mill to be ceased.

17. The apparatus of claim 1 further comprising an operator input configured to facilitate operator input of a characteristic of material within the mill from which the controller determines a degree of rotation threshold value up to which the mill may rotate prior to cascading of material in the mill before the controller generates control signals causing rotation of the mill to be ceased.

18. A method for detecting locked charge, comprising:

depositing a charge into a mill; applying torque to the mill;

sensing a parameter corresponding to rotation of the mill; and modifying rotation of the mill based upon a rate of acceleration of the mill during start-up.

19. The method of claim 18, wherein the charge includes ores.

20. The method of claim 18, wherein the step of applying torque includes: generating torque; and transmitting the generated torque to the mill via a clutch.

21. The method of claim 20, wherein the torque is generated by a motor.

22. The method of claim 21, wherein the motor is a fixed speed motor.

23. The method of claim 22 including linearly increasing the transmission of the torque to the mill via the clutch.

24. The method of claim 20, wherein the clutch is an air clutch and wherein the step of transmitting the torque includes increasing air pressure within the clutch.

25. The method of claim 20, wherein the step of modifying the rotation of the mill includes disengaging the clutch in response to the rate of acceleration of the mill failing to exceed a predetermined value.

26. The method of claim 25, wherein the clutch is disengaged in response to the rate of acceleration of the mill failing to exceed a predetermined value within a predetermined extent of rotation of the mill from start-up.

27. The method of claim 26, wherein the predetermined extent is less than or equal to about 75 degrees.

28. The method of claim 18, wherein the step of modifying rotation of the mill includes ceasing the application of torque to the mill in response to the rate of acceleration of the mill failing to exceed a predetermined value.

29. The method of claim 28, wherein the application of torque to the mill is cessated in response to the rate of acceleration of the mill failing to exceed the predetermined value within a predetermined extent of rotation of the mill from start-up.

30. The apparatus of claim 17, wherein the controller is configured to determine a degree of rotation threshold value up to which the mill may rotate prior to cascading of material in the mill before the controller generates control signals causing rotation of the mill to be ceased using the characteristic of material within the mill input using the operator input.

31. The method of claim 18 further comprising receiving input from an operator, the input comprising a degree of rotation threshold value up to which the mill may rotate prior to cascading material in the mill before stopping rotation of the mill.

32. The method of claim 18 further comprising:

receiving input from an operator, the input comprising a characteristic of material within the mill; and determining a degree of rotation threshold value up to which the mill may rotate prior to cascading material in the mill before stopping rotation of the mill using the input characteristic of the material.

33. The method of claim 18, wherein the modifying of the rotation of the mill based upon a rate of acceleration of the mill only occurs during a predetermined extent of rotation of the mill during start-up.

34. The method of claim 18, wherein the modifying of the rotation of the mill based upon a rate of acceleration of the mill only occurs prior to the mill being rotated to a substantially constant speed.

* * * * *